US005429064A

United States Patent [19]

Cardenas

[11] Patent Number: 5,429,064

[45] Date of Patent: Jul. 4, 1995

[54] BOAT

[76] Inventor: Antonio Cardenas, 8/18 Wigram Street, Harris Park, New South Wales, 2150, Australia

[21] Appl. No.: 291,174

[22] Filed: Aug. 16, 1994

[30] Foreign Application Priority Data

Aug. 17, 1993 [AU] Australia ..... PM0595

[51] Int. Cl.[6] ..... B63B 35/00

[52] U.S. Cl. ..... 114/270; 440/23; 440/38

[58] Field of Search ..... 114/270; 440/21, 23, 440/38

[56] References Cited

U.S. PATENT DOCUMENTS 3,479,674 11/1969 Beymer ..... 440/23

3,487,806 1/1970 Ch'iu ..... 440/23

*Primary Examiner*—Jesús D. Sotelo

*Attorney, Agent, or Firm*—Abelman, Frayne & Schwab

[57] ABSTRACT

A water borne boat is propelled by manually energized water pumps that propel the boat by induction and reaction forces, the water pumps being manually energized by a person standing on drive members of the pumps, which are operated in the manner of a treadmill.

8 Claims, 7 Drawing Sheets

10
11
12
13
14
15
17
18
19
20
59
60
62
A
B
C
D
E
F
G
H 10
11
12
13
14
17
18
X 10
11
59
60
62
65
34
36
22

10
11
59
60
65
-35-
22

BOAT

FIELD OF THE INVENTION

The present invention relates to manually powered water jet propelled boats and, in particular, to a boat that can be propelled by means of water jets generated by the physical actions of a user.

BACKGROUND OF THE INVENTION

Manually powered boats are commonplace with the majority being of the rowing type. Less common are boats propelled by large paddle wheels which are powered by the foot peddling action of the user.

Although the array of manually powered boats is large and diverse, there appears to be no manually powered boat of the kind where the user is in a substantially upright position so that the power supplied to propel the boat is essentially determined by the user's weight and the propulsion of the boat is by way of water jets created by pressurisation of trapped water from the surrounding water medium.

All of the types of manually powered boats known to the present inventor do not effectively transfer the potential power stored in the weight of the user to the motion of the boat. In the main, these known types of manually powered boat only transfer inefficiently the user's power to the motion of the boat.

It is an object of the present invention to overcome or substantially ameliorate this problem.

The present invention also seeks to provide a manually powered boat that can be readily manufactured and easy to use.

BRIEF SUMMARY OF THE INVENTION

Accordingly, in one broad form of the invention, there is provided a manually powered boat comprising:

separately enclosed first and second water storage chambers, each of said chambers including a flexibly sealed movable wall portion adapted to move between an outwardly extended position and an inwardly extended position, reciprocating means adapted to simultaneously move the movable wall portion of one of the said chambers to an outwardly extended position, when the movable wall portion of the other of said chambers is moved to an inwardly extended position, an inlet port and an outlet port to each of said chambers for allowing unidirectional flow of water through each of said chambers from said inlet port to said outlet port, the arrangement being such that force applied reciprocatingly against the movable wall portions by an operator standing on same, causes flow of water into the one of said chambers that has its movable wall portion moving to an outwardly extended position and flow of water from the other one of said chambers that has its movable wall portion moving to an inwardly extending position, whereby the boat is propelled in a direction opposite to the direction of the flow of water between the inlet and outlet ports.

Preferably, each of the movable wall portions are pivotable about a first edge portion thereof so that they move through an arc defined between the outwardly and inwardly extended positions.

It is preferred that each of the inlet ports include a flexible one-way valve that allows the flow of water into the said chambers and blocks the flow of water therefrom.

It is also preferred that each of the outlet ports include a flexible one-way valve that allows the flow of water out of the said chambers and blocks the flow of water therein.

Preferably, the flexible one-way valves are flap valves sensitive to hydraulic pressure variation.

In a preferred form, the inlet ports to each of the said chambers receive water fed through a water entry channel having an opening to the port end of the boat.

Also, the outlet ports from each of the said chambers expel water preferably into a water exit channel that has an opening to the stern end of the boat.

Preferably, both the water entry channel and water exit channel include water flow direction diverting means adjacent their respective openings, so that the dirction of propulsion of the boat is determined by the said diverting means.

In a preferred form, the reciprocating means comprises a closed hydraulic circuit having a first end and a second end, said first end being defined by a surface of the movable wall portion of one of the said chambers, said second end being defined by a surface of the movable wall portion of the other one of said chambers, whereby movement of a first one of said wall portions to an inwardly extended position causes flow of hydraulic medium in said circuit in a first circuit flow direction so as to simultaneously move the second one of said wall portions to an outwardly extended position, and whereby movement of the said second one of said wall portions to an inwardly extended position causes flow of hydraulic medium in said circuit in a direction opposite to said first circuit flow direction so as to simultaneously move the said first one of said wall portions to an outwardly extended position.

Preferably, the closed hydraulic circuit includes a first extensible pipe means located adjacent said first end of said circuit and a second extensible pipe means located adjacent said second end of said circuit, said first and second extensible pipe means being adapted for reciprocal expansion and contraction in response to movement of said wall portions.

BRIEF DESCRIPTION OF THE DRAWINGS

In order that the invention may be more readily understood and put into practical effect, reference will now be made to the accompanying drawings, in which.

DETAILED DESCRIPTION OF THE INVENTION

The boat 10 of FIGS. 1 to 11 is preferably fabricated of an outer fibreglass frame in a configuration that is similar to a conventional jet ski boat so as to achieve optimal aerodynamic properties. In this form, the body is between about 3.5 to 5 meters long and between about 1.2 and 1.4 meters wide. There is an enclosed portion at the port end of the boat with the remainder of the body of the boat being substantially open so as to accommodate the human operator.

Figure 1:
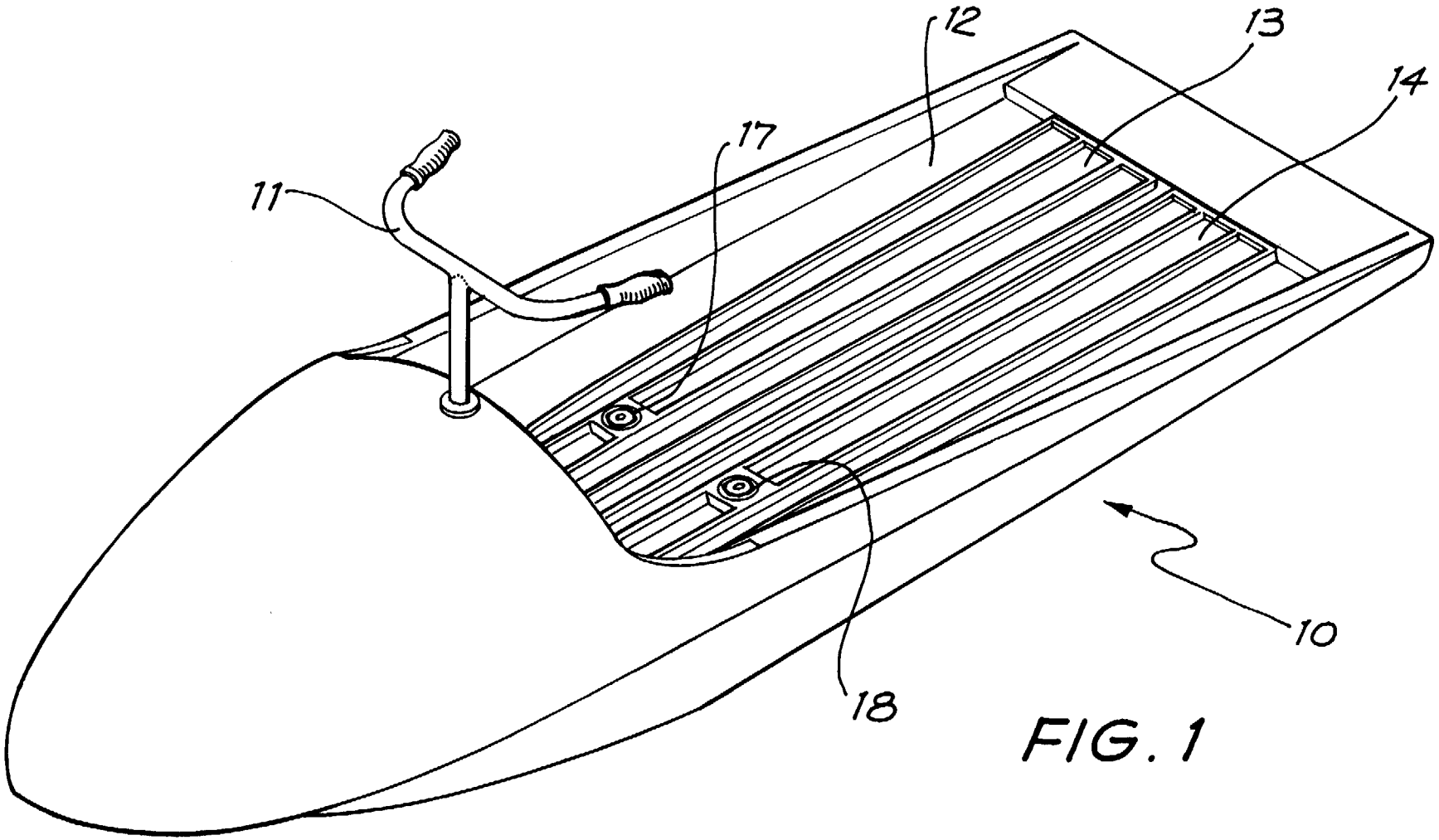
FIG. 1. is an isometric view of a manually powered boat according to a preferred embodiment of the present invention.
Figure 2:
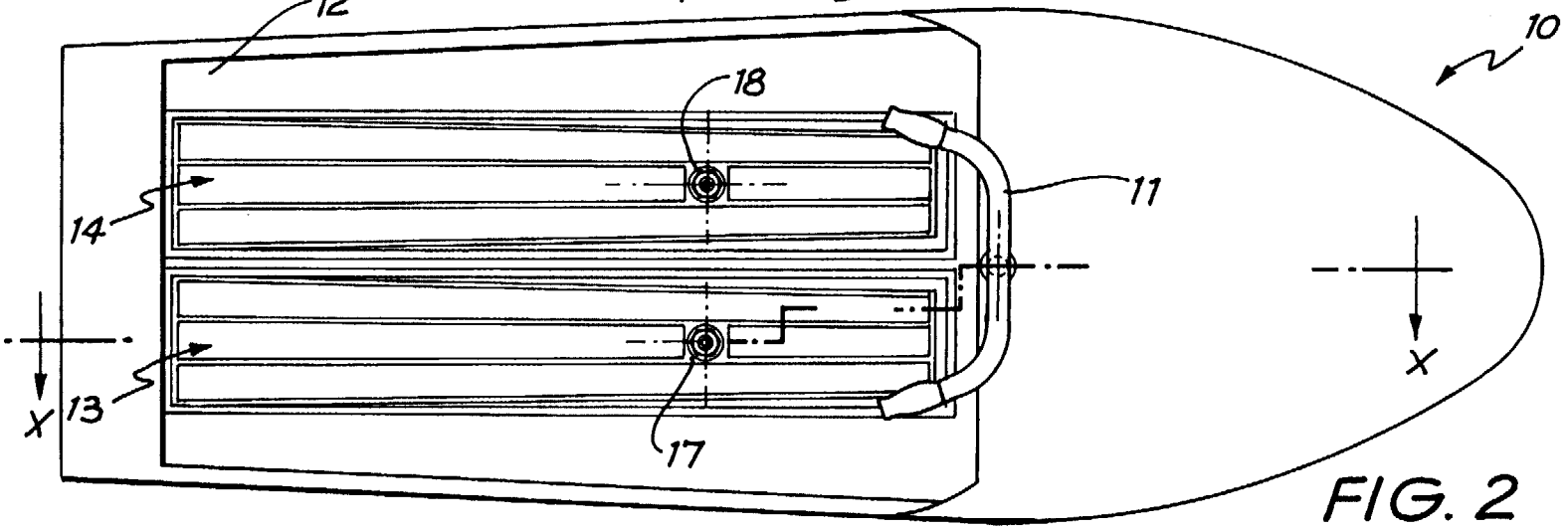
FIG. 2 is a top view of the boat of FIG. 1.
Figure 11:
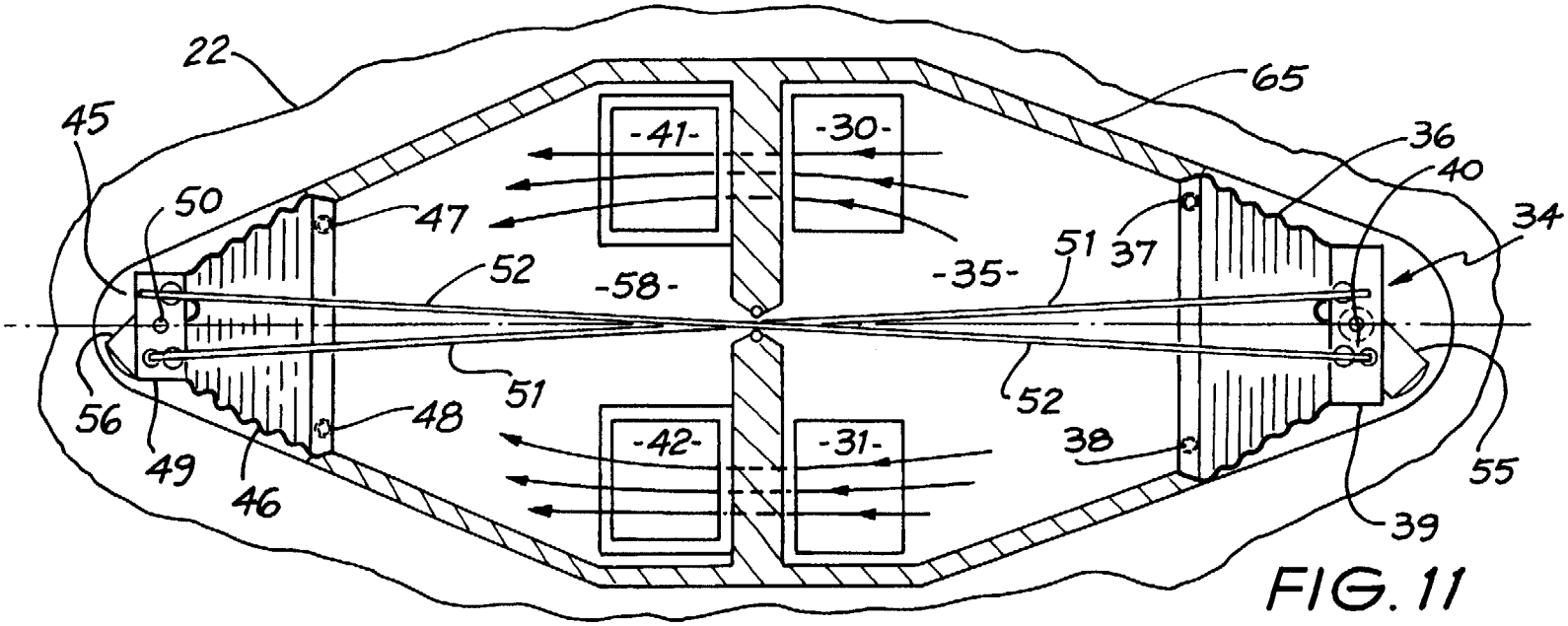
FIG. 11 is a sectional view through H—H of the boat of FIG. 3.

Referring to FIGS. 1 and 2, the boat 10 has a sterring handle device 11 connected by suitable linkage means (see FIGS. 3 and 4) to a chute-like directional system for the boat (see FIG. 11). The floor 12 of the open portion of the boat consists of two grooved platforms 13 and 14, each platform including three longitudinally extending grooves. The central groove of each platform has a raised portion 17 and 18 that plays a role in the propulsion system of the boat to be described in detail later.

The operator of the boat stands in an essentially upright position with the hands gripping firmly the steering handle device 11 and the feet located on the central grooves of both platforms forward of the raised portions 17 and 18.

The platforms 13 and 14 comprise upper movable wall portions of a pair of chambers 15 and 16 (see FIGS. 6 to 10) located thereunder.

Each platform 13 and 14 is flexibly sealed to the floor 12 of the boat by a flexible diaphragm like sheet 19, such as PVC nylon, so as to separately enclose the pair of chambers 15 and 16. Each platform 13 and 14 is pivotable about a pivotal axis located adjacent the rear edges 20 thereof. In this way, each platform 13 and 14 can move through an arc defined between an outwardly extended position and an inwardly extended position (see platforms 13 and 14 of FIG. 9).

The arrangement of having the movable platforms defining a wall portion of an enclosed chamber is similar to the operation of a conventional bellows.

The volume of each of the chambers 15 and 16 varies according to the position of the platforms 13 and 14.

The relative positions of the platforms 13 and 14 are determined by a reciprocating means that operates so that as the platform of one chamber is moving to, say, an outwardly extended position, the platform of the other chamber is simultaneously moving to an inwardly extended position (see series of positions shown in FIGS. 6 to 10), thereby maintaining constant the total volume of both chambers 15 and 16.

Figure 9:
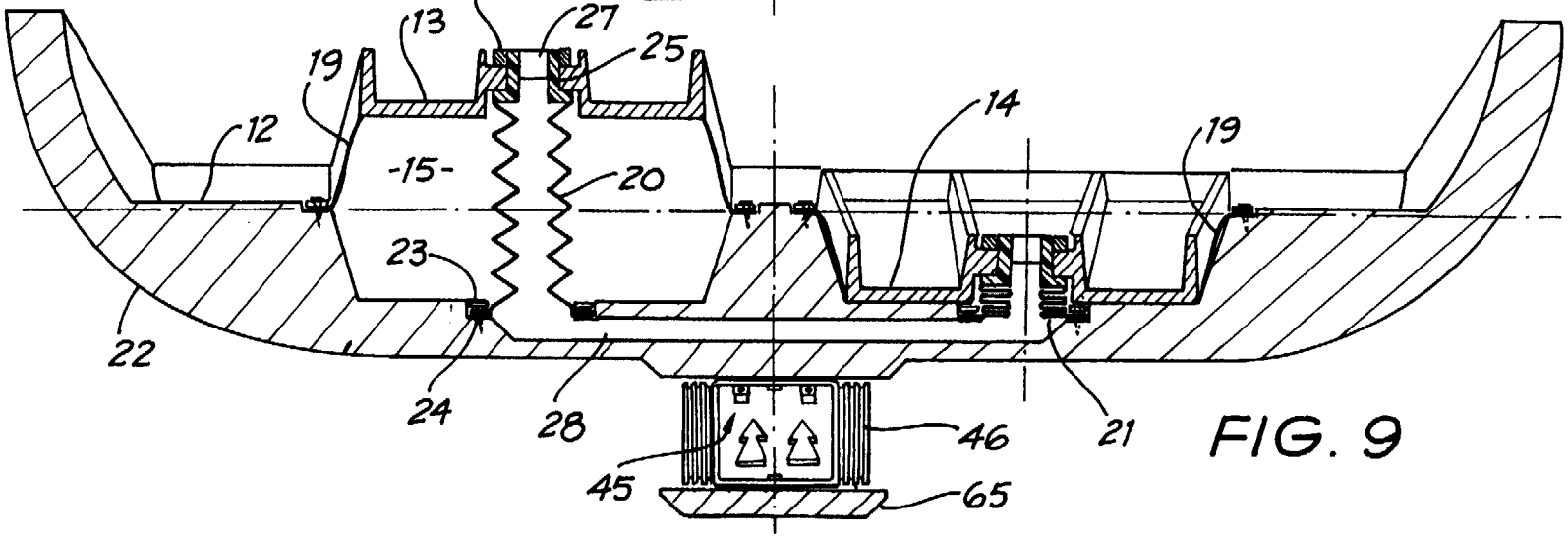
FIG. 9 is a sectional view through F—F of the boat of FIG. 3.
Figure 10:
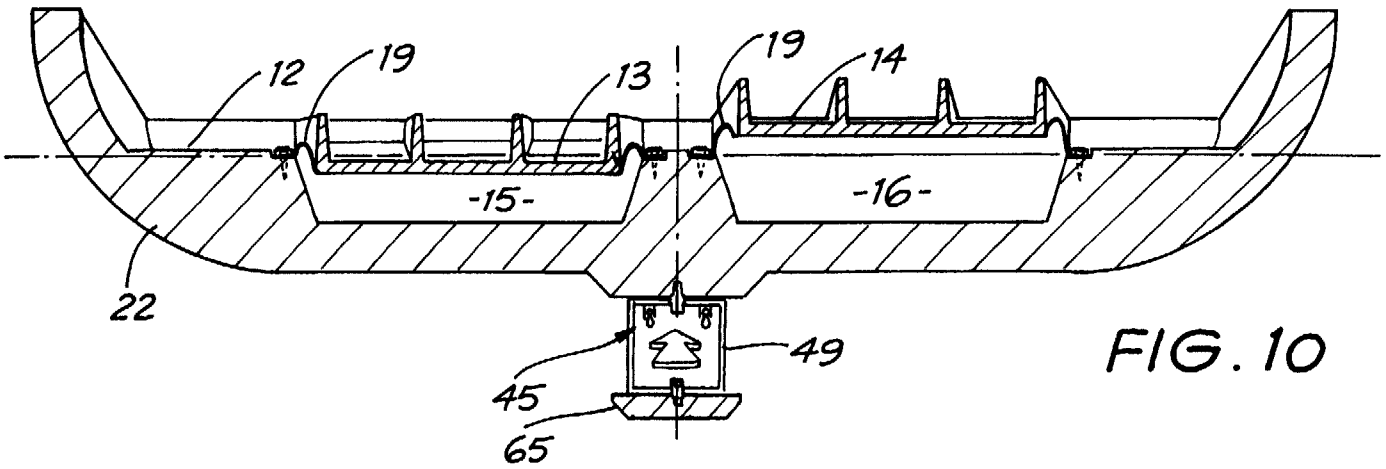
FIG. 10 is a sectional view through G—G of the boat of FIG. 3.

As particularly shown in FIG. 9, the reciprocating means is comprised of a closed hydraulic circuit operating between platform 13 and platform 14. Extensible pipes 20 and 21 capable of expansion and contraction have upper ends which are sealed to a portion of the lower surface of platforms 13 and 14 respectively so as to constitute first and second ends of the circuit. The upper ends of the extensible pipes 20 and 21 are sealed to the underside of the raised portions 17 and 18 of the platforms 13 and 14 respectively by a bottle neck join piece 25, a nut 26 therefor and a threaded stopper 27. The join pieces 25 are made of semi-rigid nylon and are secured by adhesive or the like to a corresponding shaped hole in each of the raised portions 17 and 18.

The lower ends of the extensible pipes 20 and 21 are fixed in position to an inner annular surface portion of the hull 22 by a combination of a steel ring 23 and semi-rigid nylon ring 24.

There is a channel 28 formed in the hull 22 that allows liquid communication between the lower ends of the extensible pipes 20 and 21. The continuous space within both extensible pipes 20 and 21 and channel 28 is sealed to the outside and is filled with hydraulic medium, such as water, thus forming the closed hydraulic circuit. Water can be introduced into the closed hydraulic circuit by removing the threaded stopper 27 and pouring water therethrough.

The flow of water in the closed hydraulic circuit shown in FIG. 9 is represented by the arrows.

When downward pressure is applied to platform 14, water in the hydraulic circuit is caused to flow through the circuit in a direction towards the platform 13, thereby causing the extension of extensible pipe 20 and contraction of extensible pipe 21. An amount of pressure sufficient to cause platform 14 to move to its most inwardly extended position is also sufficient to cause platform 13 to move to its most outwardly extended position. In this way, reciprocal expansion and contraction of the two extensible pipes 20 and 21 is determined by the movement of the platforms 13 and 14 respectively.

The movement of the platforms 13 and 14 also plays a role in the propulsion of the boat.

Each chamber 15 and 16 has an inlet port and an outlet port for allowing water, such as seawater on which the boat floats, to flow unidirectionally therebetween.

Figure 6:
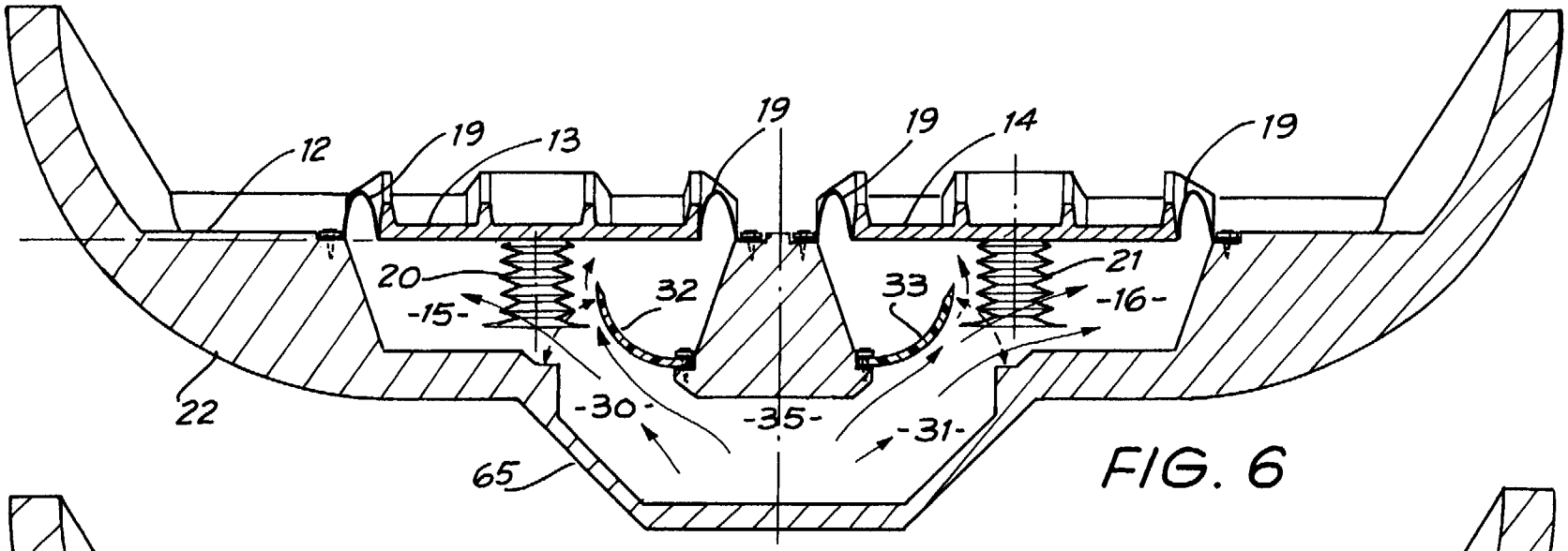
FIG. 6 is a sectional view through C—C of the boat of FIG. 3.
Figure 7:
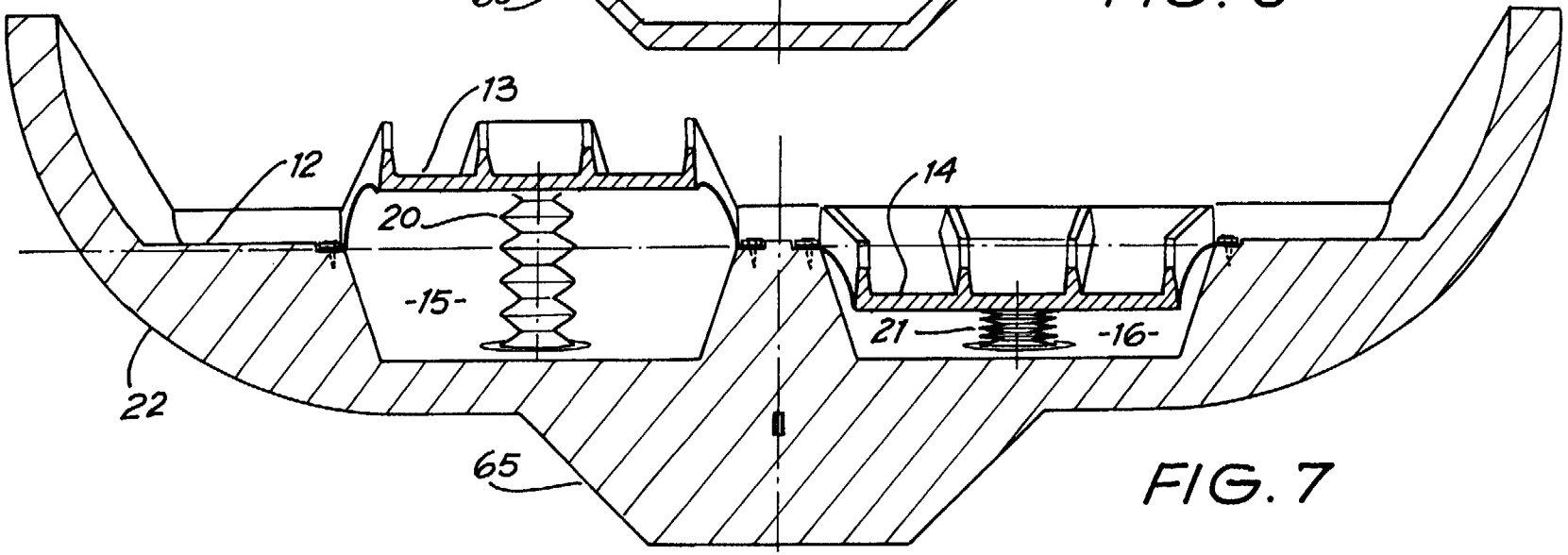
FIG. 7 is a sectional view through D—D of the boat of FIG. 3.

As shown in FIG. 6, there are inlet ports 30 and 31 for each of chambers 15 and 16 respectively. Inlet port 30 has a flexible one-way valve 32, such as a flap valve, that allows flow of sea water from the outside environment via the underside portion 65 into chamber 15 but blocks flow of sea water in the reverse direction. Inlet port 31 also has a flexible one-way valve 33 that allows flow of sea water from the outside environment into chamber 16 but blocks flow of sea water therefrom.

Figure 3:
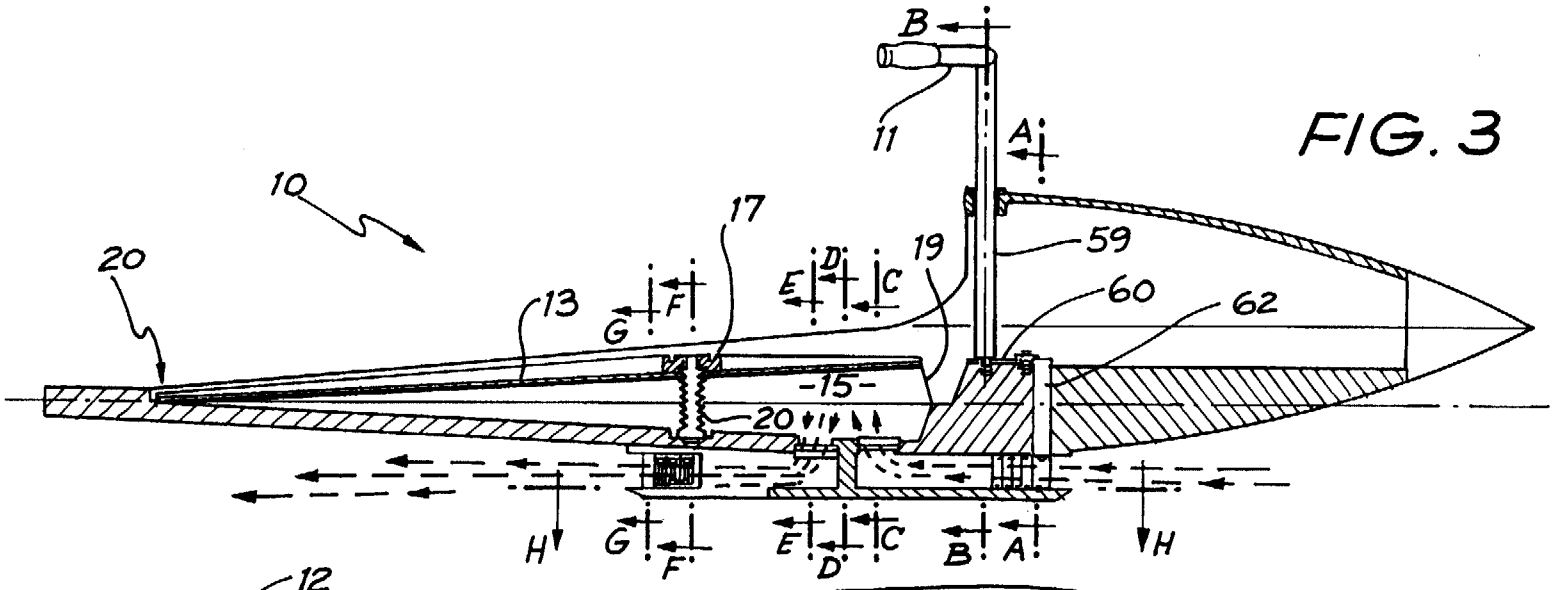
FIG. 3 is a sectional view through X—X of the boat of FIG. 2.

Referring to FIGS. 3 and 11, the inlet ports 30 and 31 for chambers 15 and 16 allow sea water that has entered the underside portion 65 via the opening 34 of the sea water entry channel 35 to enter chambers 15 and 16.

The opening 34 is defined by a water flow direction diverting jacket 36. The jacket 36 for the opening 34 is flexible and has its largest diameter opening fixed to the underside portion 65 at locations 37 and 38 and has its smallest diameter opening connected to a forward chute member 39. The chute member 39 is pivotable about pivot pin 40 so as to present different angles of orientation for entry of sea water therethrough.

Figure 8:
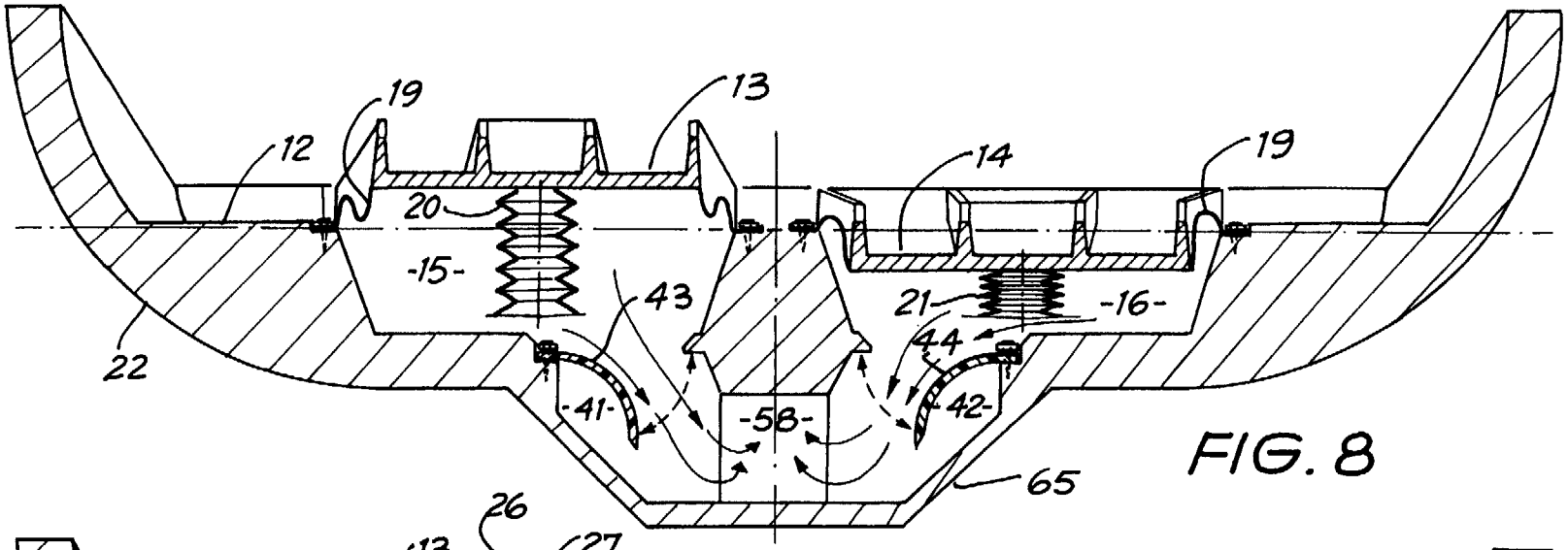
FIG. 8 is a sectional view through E—E of the boat of FIG. 3.

As shown in FIG. 8, there are outlet ports 41 and 42 for each of chambers 15 and 16 respectively. The outlet ports 41 and 42 have similar valves 43 and 44 to those for inlet ports 30 and 31, the difference being that valves 43 and 44 only allow flow of sea water out of the chambers 15 and 16 respectively.

The outlet ports 41 and 42 expel sea water from chambers 15 and 16 into the underside portion 65 which then releases the sea water to the outside environment through the opening 45 defined by the flexible jacket 46 of the sea water exit channel 58. The jacket 46 has its largest diameter opening fixed to the underside portion 65 at locations 47 and 48 and has its smallest diameter opening connected to a rear chute member 49 that can pivot about pivot pin 50 so as to present different angles of orientation for release of sea water therethrough.

The angles of orientation of both forward and rear chute members 39 and 49 can vary according to the flexible property of the jackets 36 and 46, the pivot pins 40 and 50 and the linkage rods 51 and 52.

As shown in FIG. 11, linkage rod 51 has both its ends separately rotatably connected to chute member 39 and chute member 49. Similarly, linkage rod 52 is rotatably connected adjacent both its ends to chute members 39 and 49 but is orientated so as to cross the linkage rod 51 near their respective midpoints. Both linkage rods 51 and 52 do not touch each other at their cross over points. The linkage rods 51 and 52 ensure that when the forward chute member 39 is pivoted to a particular angle, the other rear chute member 49 pivots to a related angle as determined by the linkage rods 51 and 52. For instance, if forward chute member 39 is pivoted to a position as shown by numeral 55, the linkage rods 51 and 52 cause the rear chute member 49 to move to a position as shown by numeral 56.

Both these positions 55 and 56 enable the boat to attain an optimal turning circle in the desired direction.

Water entering the boat through the chute member 39 and being released from the boat through the chute member 49 may thus be caused to flow in desired directions depending on the related angles of orientation of the chute members.

The forward chute member 39 is subject to pivotal movement in response to the action of the linkage means to the steering handle device 11.

Figure 4:
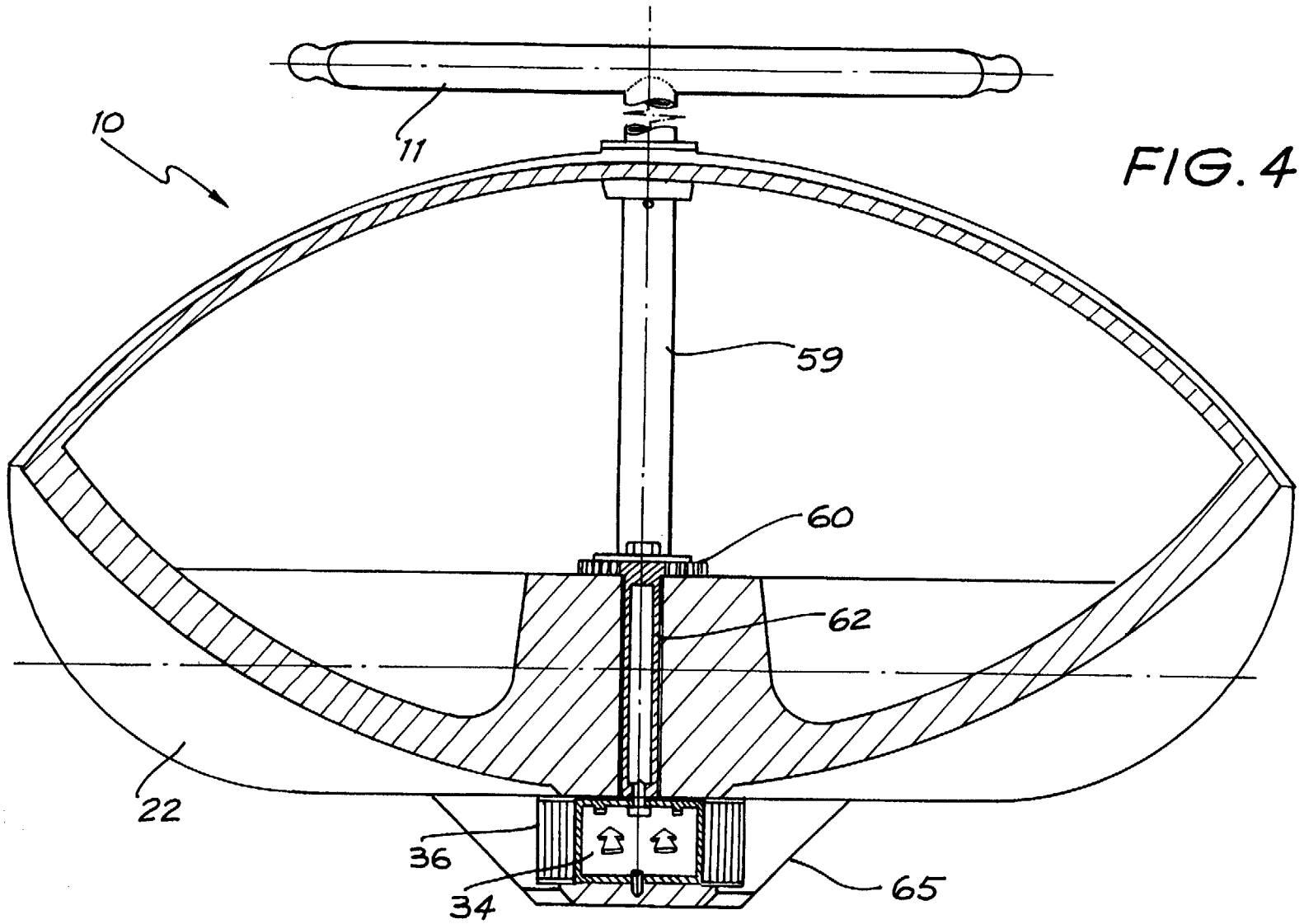
FIG. 4 is a sectional view through A—A of the boat of FIG. 3.
Figure 5:
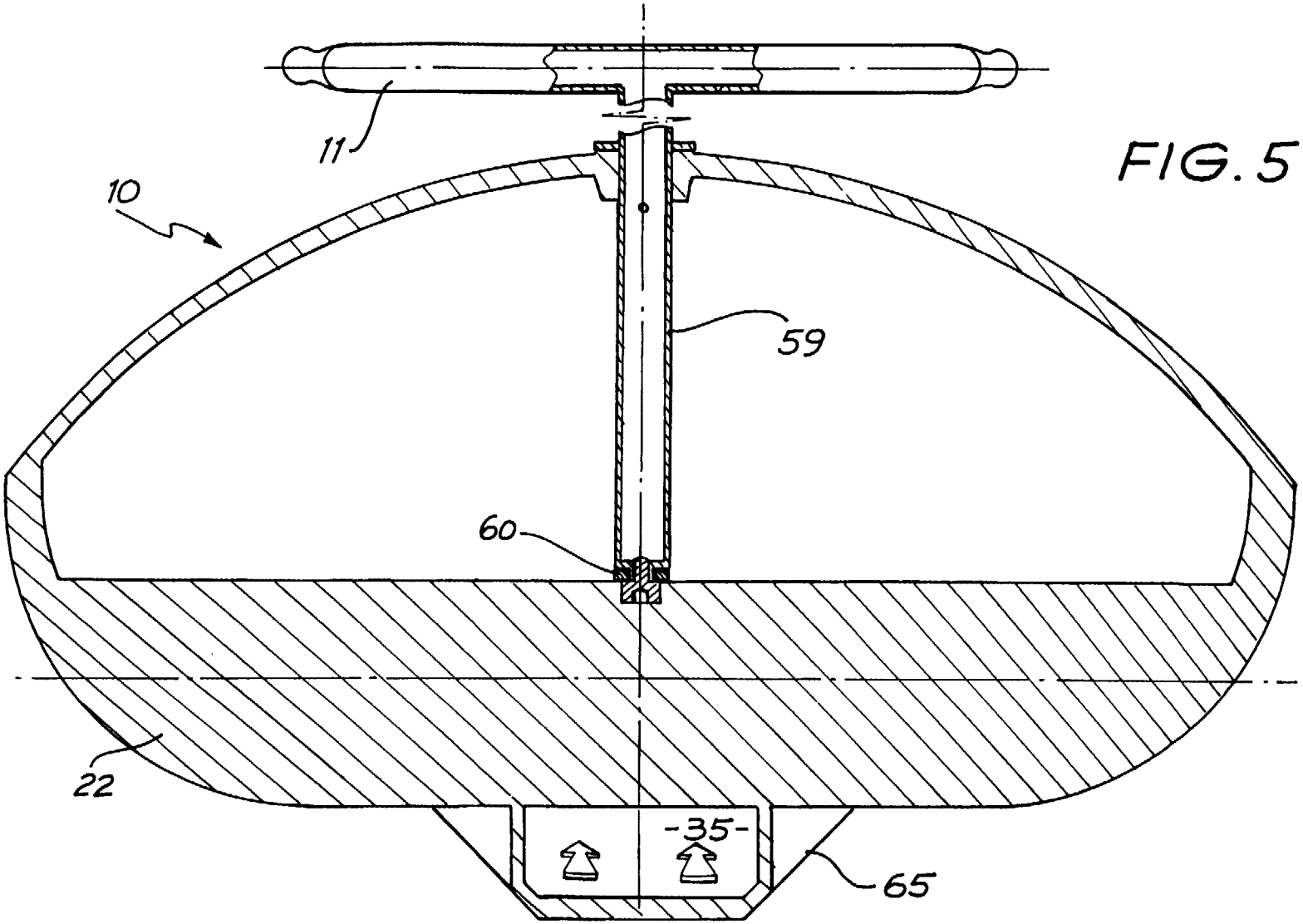
FIG. 5 is a sectional view through B—B of the boat of FIG. 3.

The steering linkage means is shown in FIGS. 3 and 4. The vertical column 59 descending from the handle device 11 is connected by way of a gear system 60 to a shaft 62. The shaft 62, in turn, connects to the pivot pin 40 that rotatably supports the chute member 39. As a result, turning the handle device 11 causes pivotal motion of the forward chute member 39 which, in turn, causes related pivotal motion of rear chute member 49.

In order to propel the boat in a forward direction, an operator should stand in a substantially upright position with the operator's left and right feet being on the platforms 14 and 13 respectively in a position forward of the raised portions 18 and 17.

The operator must apply force reciprocatingly against the platforms 13 and 14 in a manner similar to the pedalling of a bicycle whilst holding firmly the handle device 11, the major difference to bicycle pedalling being that here the feet move in a substantially vertical only up and down path with no orbital type movement.

As the operator forces the platform 14 downwardly with the left foot, the closed hydraulic circuit described earlier causes the platform 13 to move upwardly. Similarly, when the right foot presses down on the platform 13, the platform 14 must, through the action of the closed hydraulic circuit, move upwardly. Therefore, the operator must not apply equal downward force simultaneously with both feet.

As both chambers 15 and 16 are, during use, filled with sea water, pressing platform 14 downwardly will cause sea water to be expelled from chamber 16 out through the outlet port 42 via the flap valve 44 and into the water exit channel 58. This sea water is then released to the sea water surrounding the boat through the flexible jacket 46 and rear chute member 49 that, together with the linkage rods 51 and 52, divert the flow of the released water in the desired direction for determining the direction of propulsion of the boat.

At the same time as platform 14 is being pressed downwardly, platform 13 is moving upwardly, thereby creating a pressure tendency for sea water to enter chamber 15 through flap valve 32 from the water entry channel 35. This sea water initially enters the boat through the flexible jacket 36 and forward chute member 39 that, together with the linkage rods 51 and 52, divert the direction of flow of water entering the boat as desired to assist in directing the motion of the boat.

The largest and smallest possible volumes of chambers 15 and 16 respectively are shown in FIG. 9. At the stage shown in FIG. 9, the optimal volume of sea water has been expelled from the chamber 16 and has been released to the surrounding sea water through rear chute member 49 as a jet of water. Simultaneously, sea water has been pumped into chamber 15 via forward chute member 39.

The amount of sea water present in chambers 15 and 16 should fill their available volumes so as to avoid air pockets that may limit the efficiency of the propulsion system.

After the operator has pressed the platform 14 fully downwardly, the operator may then apply downward pressure with the right foot so as to force the platform 13 downwardly. Platform 14 will then, of course, move upwardly in response to the action of the closed hydraulic circuit.

As the platform 13 is being forced downwardly, sea water in chamber 15 is expelled through flap valve 43 into exit channel 58 and then out from the boat via rear chute 49. At the same time, sea water is entering the chamber 16 as its volume enlarges via the flap valve 33.

The combination of creating a rear water jet through rear chute 49 and the pumping of sea water into the boat via the forward chute 39 serves to propel the boat in a direction opposite to the flow of water through the boat.

Whilst the operator is continuously moving the platforms 13 and 14 in a reciprocating manner, a constant water jet is exiting the rear of the boat into the surrounding sea water, thereby causing smooth motion of the boat.

The operator can thus use all of his or her weight in an efficient standing position to propel the boat, and so the boat may be used for sporting or recreational applications.

Various modifications may be made in detail of design and construction without departing from the scope or ambit of the invention.

I claim:

1. A manually powered boat comprising:

separately enclosed first and second water strorage chambers, each of said chambers including a flexibly sealed movable wall portion adapted to move between an outwardly extended position and an inwardly extended position;

reciprocating means adapted to simultaneously move the movable wall portion of one of the said chambers to an outwardly extended position, when the movable wall portion of the other of said chambers is moved to an inwardly extended position, wherein the reciprocating means comprises a closed hydraulic circuit having a first end and a second end, said first end being defined by a surface of the movable wall portion of one of said chambers, said second end being defined by a surface of the movable wall portion of the other one of said chambers, whereby movement of a first one of a said wall portions to an inwardly extended position causes flow of hydraulic medium in said circuit in a first circuit flow direction so as to simultaneously move the second one of said wall portions to an outwardly extended position, and whereby movement of the said second one of said wall portions to an inwardly extended position causes flow of hydraulic medium in said circuit in a direction opposite to said first circuit flow direction so as to simultaneously move the said first one of said wall portions to an outwardly extended position, and an inlet port and an outlet port to each of said chambers for allowing unidirectional flow of water through each of said chambers from said inlet port to said outlet port;

the arrangement being such that force applied reciprocatingly against the movable wall portions by an operator standing on same, causes flow of water into the one of said chambers that has its movable wall portion moving to an outwardly extended position and flow of water from the other one of said chambers that has its movable wall portion moving to an inwardly extending position, whereby the boat is propelled in a direction opposite to the direction of the flow of water between the inlet and outlet ports.

2. The boat of claim 1 wherein each of the movable wall portions are pivotable about a first edge portion thereof so that they move through an arc defined between the outwardly and inwardly extended positions.

3. The boat of claim 1 wherein each of the inlet ports include a flexible one-way valve that allows the flow of water into the said chambers and blocks the flow of water therefrom and each of the outlet ports include a flexible one-way valve that allows the flow of water out of the said chambers and blocks the flow of water therein.

4. The boat of claim 3 wherein the flexible one-way valves are flap valves sensitive to hydraulic pressure variation.

5. The boat of claim 1 wherein the inlet ports to each of the said chambers receive water fed through a water entry channel having an opening to the port end of the boat.

6. The boat of claim 5 wherein the outlet ports from each of the said chambers expel water into a water exit channel that has an opening to the stern end of the boat.

7. The boat of claim 6 wherein both the water entry channel and water exit channel include water flow direction diverting means adjacent their respective openings, so that the direction of propulsion of the boat is determined by the said diverting means.

8. The boat of claim 1 wherein the closed hydraulic circuit includes a first extensible pipe means located adjacent said first end of said circuit and a second extensible pipe means located adjacent said second end of said circuit, said first and second extensible pipe means being adapted for reciprocal expansion and contraction in response to movement of said wall portions.

* * * * *